US005757349A

United States Patent [19]

Togashi

[11] Patent Number: 5,757,349

[45] Date of Patent: May 26, 1998

[54] LIQUID CRYSTAL DISPLAY DEVICE AND A METHOD OF DRIVING THE SAME

[75] Inventor: Seigo Togashi, Sakado, Japan

[73] Assignee: Citizen Watch Co., Ltd., Japan

[21] Appl. No.: 553,176

[22] Filed: Nov. 7, 1995

[30] Foreign Application Priority Data

Nov. 8, 1994 [JP] Japan ..... 6-273943
Nov. 9, 1994 [JP] Japan ..... 6-275248

[51] Int. Cl.[6] ..... G09G 3/36

[52] U.S. Cl. ..... 345/91; 345/95; 345/96; 345/208

[58] Field of Search ..... 345/208, 92–99, 345/91, 205, 204–210; 359/55; 349/49–51

[56] References Cited

U.S. PATENT DOCUMENTS

| | | | |
|---|---|---|---|
| 4,701,026 | 10/1987 | Yazaki et al. | 350/333 |
| 4,743,096 | 5/1988 | Wakai et al. | 350/333 |
| 4,945,352 | 7/1990 | Ejiri | 340/805 |
| 4,976,515 | 12/1990 | Hartman | 345/97 |
| 5,061,044 | 10/1991 | Matsunaga | 345/97 |
| 5,204,660 | 4/1993 | Kamagami et al. | 340/784 |
| 5,264,953 | 11/1993 | Hirai et al. | 359/55 |
| 5,363,225 | 11/1994 | Minamihara et al. | 345/97 |
| 5,396,352 | 3/1995 | Kaneko et al. | 345/97 |
| 5,408,252 | 4/1995 | Oki et al. | 345/205 |
| 5,412,397 | 5/1995 | Kanatani et al. | 345/99 |
| 5,424,753 | 6/1995 | Kitagawa et al. | 345/94 |
| 5,432,527 | 7/1995 | Yanai et al. | 345/92 |
| 5,515,072 | 5/1996 | Yanai et al. | 345/92 |
| 5,594,464 | 1/1997 | Tanaka et al. | 345/94 |

FOREIGN PATENT DOCUMENTS

| | | |
|---|---|---|
| 0 600 096 A1 | 6/1994 | European Pat. Off. . |
| 0 616 331 A2 | 9/1994 | European Pat. Off. . |

*Primary Examiner*—Steven Saras
*Assistant Examiner*—David L. Lewis
*Attorney, Agent, or Firm*—Finnegan, Henderson, Farabow, Garrett & Dunner, L.L.P.

[57] ABSTRACT

An active matrix addressed liquid crystal display device includes: a plurality of data lines; a plurality of scan lines each intersected with each of the plurality of data lines; liquid crystal elements each provided to each intersecting point of the plurality of data lines and scan lines; two-terminal switching elements each provided to each intersecting point of the plurality of data lines and scan lines; a data line drive unit for generating data signals to drive the data lines; and a scan line drive unit for generating scan signals to drive the scan lines. The scan signals are formed of a selecting term, a current applying term preceding the selecting term, and a holding term following the selecting term. The current applying term is formed by more than three current applying small terms. The three small terms are formed by the same polarity of potential as that of the selecting term, and by the polarity of potential opposite to that of the selecting term.

24 Claims, 14 Drawing Sheets

(IDEAL CHARACTERISTICS)

(ACTUAL CHARACTERISTICS)

(IDEAL CHARACTERISTICS)

(ACTUAL CHARACTERISTICS)

LIQUID CRYSTAL DISPLAY DEVICE AND A METHOD OF DRIVING THE SAME

BACKGROUND OF THE INVENTION

1. Field of the Invention

The present invention relates to a liquid crystal display device and a method of driving the same. The present invention is advantageously used in flat panel display systems, for example, a television, a display of a personal computer, an information pad, etc.

2. Description of the Related Art Recently, a liquid crystal display device, which contains a flat panel display, has been widely utilized in various fields. The liquid crystal display device has many advantages, for example, low power consumption, flatness, small size, etc.

In the liquid crystal display device, there are known many types which can be listed in accordance with the mode of the liquid crystal and the drive method thereof.

Particularly, an active matrix addressed liquid crystal display (LCD) device, in which a switching element is connected to the liquid crystal element in order to control drive of the element, has been known as the flat panel display having a large capacity and high quality display elements. Accordingly, the flat panel display structured by the active matrix addressed LCD has been widely employed as a display for televisions, a display for personal computers, etc.

In the active matrix addressed LCD, there are many types of the switching element, for example, a three-terminal switching element formed by a TFT (Thin Film Transistor), and a two-terminal switching element formed by a diode or an MIM (Metal-Insulator-Metal) element used as a non-linear resistance element. In general, the above two-terminal switching element can be easily produced compared to the three-terminal switching element so that the former has been widely utilized in various liquid crystal displays.

Accordingly, the present invention aims to improve an active matrix addressed liquid crystal display device having the two-terminal switching element and a method of driving the same as explained below.

SUMMARY OF THE INVENTION

The object of the present invention is to provide an improved liquid crystal display device and a method of driving the same by increasing an amount of current flowing in the switching element without adding additional circuits or increasing the voltage-proof value of the element. As a result, the present invention can considerably reduce an image sticking or an afterimage on the screen of the liquid crystal display device.

In accordance with one aspect of the present invention, there is provided a liquid crystal display device including:

a plurality of data lines;

a plurality of scan lines each intersected with each of the plurality of data lines;

liquid crystal elements each provided to each intersecting point of the plurality of data lines and scan lines;

two-terminal switching elements each provided to each intersecting point of the plurality of data lines and scan lines;

a data line drive unit for generating data signals to drive the data lines; and a scan line drive unit for generating scan signals to drive the scan lines; each scan signal being formed of a selecting term, a current applying term preceding the selecting term, and a holding term following the selecting term; the current applying term being formed by more than three current applying small terms; and the three small terms being formed by the same polarity of potential as that of the selecting term, and by the polarity of potential opposite to that of the selecting term.

In a preferred embodiment, the current applying term is formed by more than four current applying small terms; and the more than four small terms include more than two of the small terms having the same polarity of potential as that of the selecting terms, and more than two of the small terms have the polarity of potential opposite to the selecting terms.

In another preferred embodiment, the current applying term utilizes selecting terms of other scan lines, and the polarity of potential of the scan signals at the current applying term having the same polarity of potential as that of a selecting term at other scan lines.

In still another preferred embodiment, the potential at the small terms at the current applying term is approximately equal to that of a positive potential or a negative potential of selecting term.

In accordance with another aspect of the present invention, a liquid crystal display device including: a scan line drive unit for generating scan signals to drive the scan lines; each scan signals being formed of a selecting term, a current applying term preceding the selecting term, and a holding term following the selecting term; the current applying term being formed by a plurality of discontinuous current applying small terms; and the polarity of potential of the data signals at said current applying small terms being opposite to that of the scan signals at the current applying small terms.

In a preferred embodiment, each of the data signals becomes an upper data potential Vd1, a lower data potential Vd2 and/or intermediate data potential therebetween in the selecting term, and becomes either the upper data potential Vd1 or the lower data potential Vd2 in the current applying small terms of the scan signals.

In another preferred embodiment, each of the scan signals becomes an upper selecting potential Va1 and a lower selecting potential Va2 in the selecting terms, becomes an upper holding potential Vb1 and a lower holding potential Vb2 in the holding terms, and becomes the upper selecting potential Va1 and the lower selecting potential Va2 in the current applying small terms preceding the selecting terms.

In still another preferred embodiment, the current applying small terms utilize a horizontal retracing term of a video signal.

In still another preferred embodiment, each of the small terms is set to less than one-third of said selecting term.

In accordance with still another aspect of the present invention, a method for driving a liquid crystal display device including: a plurality of data lines; a plurality of scan lines each intersected with each of the plurality of data lines; liquid crystal elements each provided to each intersecting point of the plurality of data lines and scan lines; two-terminal switching elements each provided to each intersecting point of the plurality of data lines and scan lines; a data line drive unit for generating data signals to drive the data lines; and a scan line drive unit for generating scan signals to drive said scan lines; the method including the steps of:

setting each the scan signals so as to be formed of a selecting term, a current applying term preceding the selecting term, and a holding term following the selecting term;

setting the current applying term so as to be formed by more than three current applying small terms; and setting the three small terms so as to be formed by the same polarity of potential as that of said selecting term, and by the polarity of potential opposite to that of the selecting term.

In accordance with still another aspect of the present invention, the method comprising the steps of:

setting each the scan signals so as to be formed of a selecting term, a current applying term preceding the selecting term, and a holding term following the selecting term;

setting the current applying term so as to be formed by a plurality of discontinuous current applying small terms; and setting the polarity of potential of the data signals at the current applying small terms so as to be opposite to that of the scan signals at the current applying small terms.

DESCRIPTION OF THE PREFERRED EMBODIMENTS

Before describing preferred embodiments of the present invention, a conventional art and its problem will be explained below.

Figure 1:
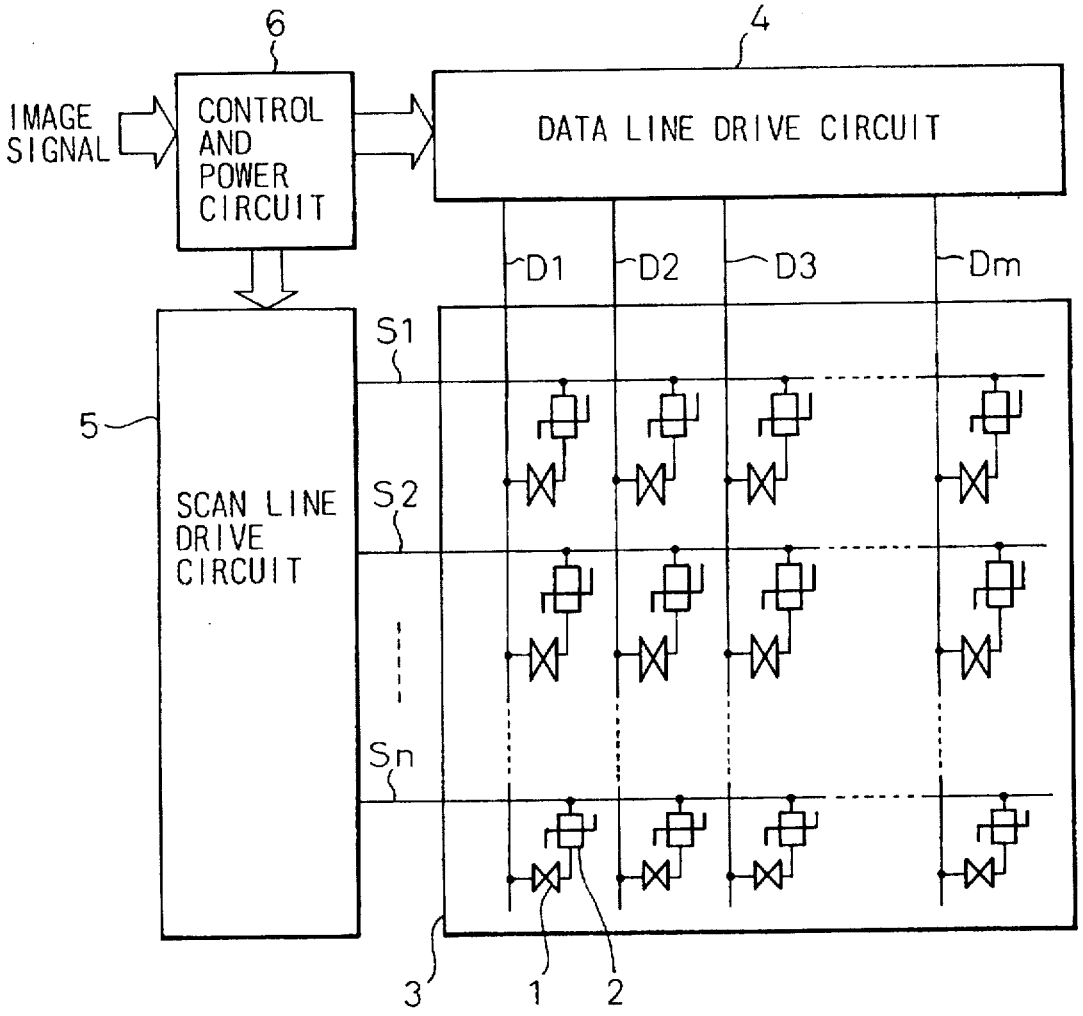
FIG. 1 is a basic block diagram of an active matrix addressed liquid crystal display device using two-terminal switching elements, and this drawing is used for explaining both a conventional art and the present invention.

FIG. 1 is a basic block diagram of an active matrix addressed liquid crystal display device using two-terminal switching elements. This drawing is used for explaining both the conventional art and the present invention. In the drawing, reference number 1 denotes a liquid crystal element (below, pixel), 2 a two-terminal switching element, 3 a matrix display panel, 4 a data line drive circuit, 5 a scan line drive circuit, 6 a control circuit including a power circuit, and 7 an image signal. Further, D1 to Dm denote data lines, and S1 to Sn denote scan lines.

As shown in FIG. 1, the data lines D1 to Dm and the scan lines S1 to Sn are provided in matrix in the display panel 3. The pixel 1 and the switching element 2 are provided to each intersecting point of the data line D and the scan line S. That is, one terminal of the pixel 1 is connected to the data line D and the other terminal thereof is connected to the switching element 2. Further, the other terminal of the switching element 2 is connected to the scan line S.

The data line drive circuit 4 outputs data signals to each of data lines D1 to Dm, and the scan line drive circuit 5 outputs scan signals to each of the scan lines S1 to Sn. The control/power circuit 6 is connected to the data line drive circuit 4 and the scan line drive circuit 5 in order to apply the processed image signals, timing signals and voltages.

The MIM element having a structure of metal-insulator-metal and a non linear current-to-voltage characteristic has been widely utilized as the representative two-terminal switching element. The typical metal-insulator-metal structure includes a lower electrode metal made of tantalum (Ta), an insulator made of tantalum oxide (TaOx), and an upper electrode metal made of indium-tin-oxide (ITO).

Figures 2A, 2B, 2C, 2D:
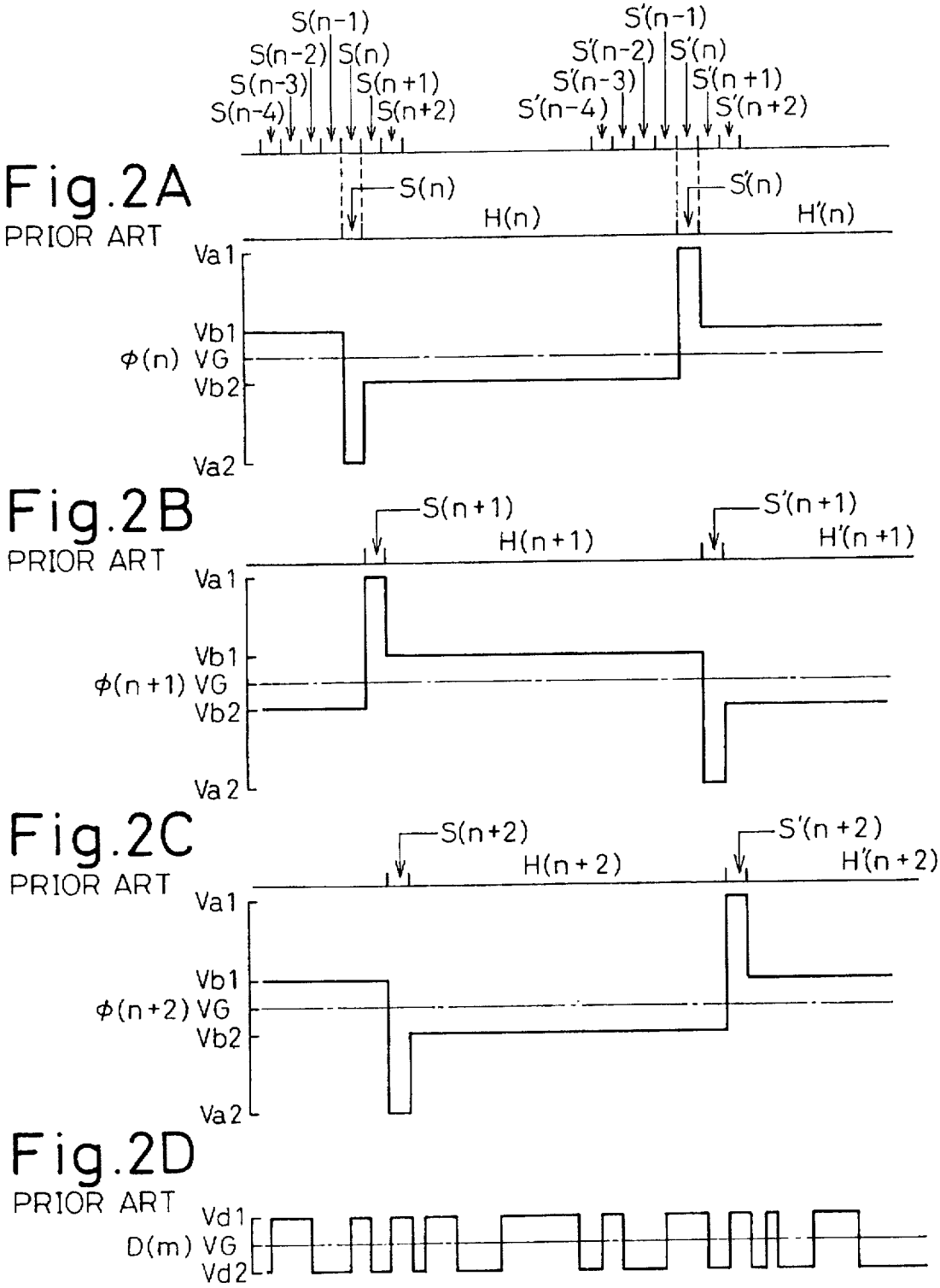
Fig.2A PRIOR ART
Fig.2B PRIOR ART
Fig.2C PRIOR ART
Fig.2D PRIOR ART
FIGS. 2A to 2D show waveforms of scan signals and data signals in an active matrix addressed liquid crystal display device having two-terminal switching elements in a conventional art.

FIGS. 2A to 2D show waveforms of the scan signals and the data signal in the active matrix addressed liquid crystal display device having the two-terminal switching elements in a conventional art. FIGS. 2A to 2C show waveforms of the scan signals $\phi(n)$, $\phi(n+1)$ and $\phi(n+2)$, and FIG. 2D shows a waveform of the data signal D(m). In this case, the scan signal $\phi(n)$ is applied from the scan line drive circuit 5 to the scan line "n", the scan signal $\phi(n+1)$ is applied to the scan line "n+1", and the scan signal $\phi(n+2)$ is applied to the scan line "n+2".

In FIGS. 2A to 2C, in selecting terms S(n), S'(n+1) and S(n+2), the scan signal indicates a negative polarity having a selecting potential Va2. In selecting terms S'(n), S(n+1) and S'(n+2), the scan signal indicates a positive polarity having a selecting potential Va1.

On the other hand, in non-selecting terms, i.e., holding terms H(n), H'(n+1) and H(n+2), the scan signal indicates the negative polarity having a holding potential Vb2. In holding terms H'(n), H(n+1) and H'(n+2), the scan signal indicates the positive polarity having a holding potential Vb1.

In FIG. 2D, the data signal D(m) is applied from the data line drive circuit 4 to the data line "m", and indicates alternately either the positive potential Vd1 or the negative potential Vd2. Although, in general, either an amplitude modulation or a pulse width modulation is used for a display of gray scale, in this embodiment, the potential of FIG. 2D is shown by pulse width modulation.

In FIGS. 2A to 2D, a reference letter VG shows a reference potential (chain-dotted line). Although the reference potential VG is shown as a constant potential in these drawings, in actuality, this reference potential can be changed in equivalent to the constant potential. That is, the reference voltage can be changed simultaneously for both data signals and scan signals. Accordingly, in many cases, the reference potential can be changed in accordance with the drive voltage of the drive circuit.

Further, although the selecting potentials Va1, Va2 and the holding potentials Vb1, Vb2 are shown as symmetrical to the reference potential VG, they are shown as asymmetrical to the reference potential when the characteristic of the two-terminal switching element is asymmetrical.

Still further, the polarity of selecting terms S(n), S(n+1) and S(n+2) is inverted for each of scan lines "n", "n+1" and "n+2", and the polarity of selecting terms S'(n), S'(n+1) and S'(n+2) is also inverted for each of scan lines "n", "n+1" and "n+2". However, as another example, the polarity of each scan term can be inverted for each field.

Figure 3A:
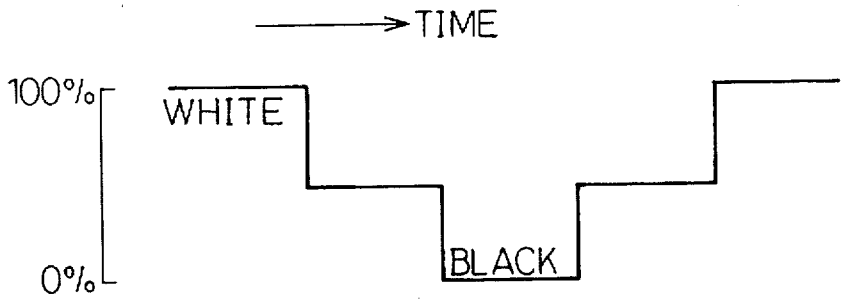
FIGS. 3A and 3B are explanatory views for explaining a transmittance of the light in the cases of an ideal characteristic (A) and an actual characteristic (B) in the conventional art.
Figure 3B:
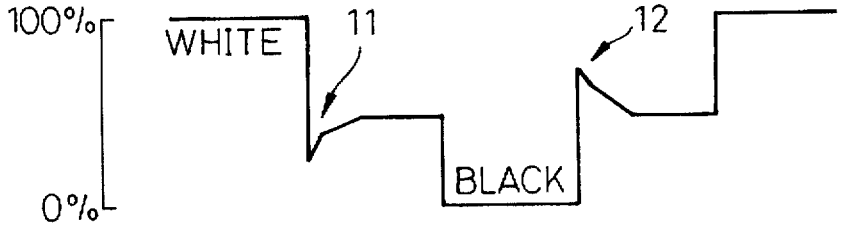
Fig.3B PRIOR ART

FIGS. 3A and 3B are explanatory views for explaining a transmission factor of the light in cases of the ideal characteristic (A) and the actual characteristic (B) in the conventional art. The most important problem or drawback in use of the MIM switching element lies in an afterimage on the screen. This problem will be explained in detail with reference to FIGS. 3A and 3B.

In FIGS. 3A and 3B, the ordinate denotes a transmittance of the light, and the abscissa denotes the time. The gray scale of the color is dependent on the transmittance. That is, the transmittance 100% indicates white, and the transmittance 0% indicates black. Further, an intermediate value of the transmittance indicates the intermediate color (gray) between white and black.

When the gray scale of the color is sequentially changed from white→intermediate color→black→intermediate color→to white, the ideal characteristic becomes as shown by FIG. 3A. That is, no image sticking or afterimage is found on the screen. However, in actuality, the image sticking or afterimage is found on the screen as shown by FIG. 3B.

That is, in the timing when the gray scales of the color are changed from white to intermediate color (gray scale), and from black to intermediate color, the transmittance is considerably changed as shown by a large dip 11 and a large peak 12. As a result, intermediate color is close to black at the dip 11, and close to white at the peak 12. The image sticking or afterimage on the screen during a predetermined term is caused by these large peak and dip.

In general, it is obvious that the large peak and dip are caused by change of a threshold voltage Vth of the switching element. Further, the change of the threshold voltage Vth is dependent on an amount of current flowing in the switching element. That is, when the large amount of the current continuously flows in the switching element, the threshold voltage Vth is increased. On the contrary, when the small amount of the current continuously flows in the switching element, the threshold voltage Vth is decreased.

Figure 4A:
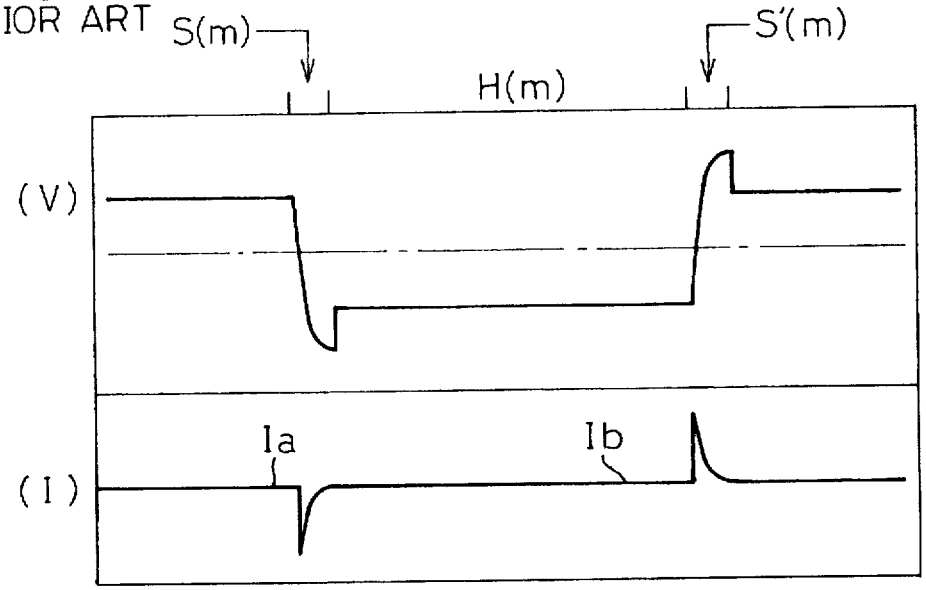
Fig.4A PRIOR ART
FIGS. 4A and 4B are waveforms of the voltage and current in the switching element when the scan signal of FIGS. 2A to 2C are applied thereto.
Figure 4B:
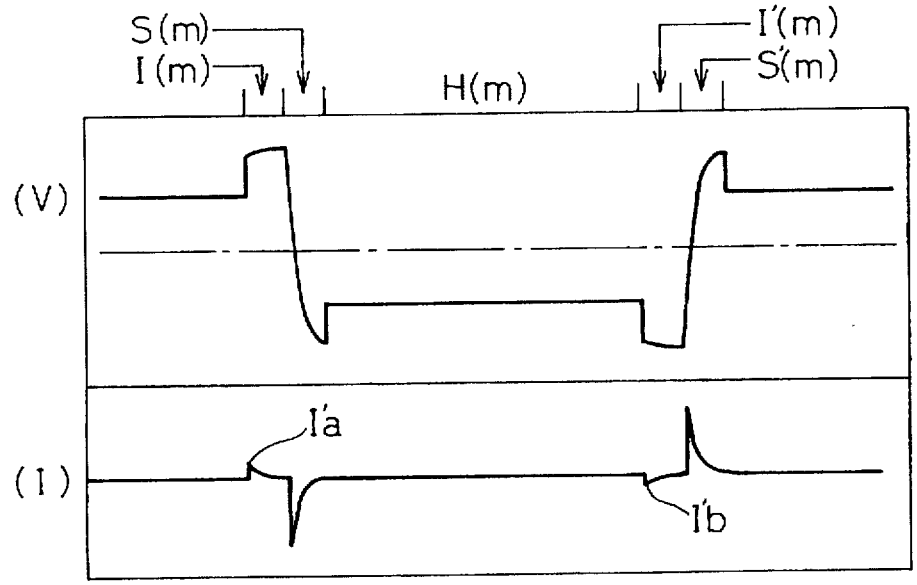
Fig.4B PRIOR ART

FIGS. 4A and 4B are waveforms of the voltage and current in the switching element when the scan signal of FIGS. 2A to 2C are applied thereto.

In FIG. 4A, as shown by the voltage waveform V, the current I flows the pixel to charge it in the form of the differential pulse in accordance with the non-linear current/voltage characteristic of the switching element in the selecting terms S(m) and S'(m). This current is dependent on the data voltage, i.e., the gray scale of the image.

When the gray scale is changed as shown by FIG. 3A, the current flowing in the switching element is also changed. Accordingly, the image sticking or afterimage occurs in the predetermined term, i.e., from the start of change of the gray scale until the stable state of the voltage, caused by the change of the threshold voltage of the switching element.

In this case, the threshold voltage Vth is basically changed either in the range of white or in the range of black. Accordingly, the image sticking or afterimage also occurs in the vicinity of white and black. However, the image sticking or afterimage is relatively small in the vicinity of white and black because the change of the transmittance is relatively small. On the other hand, the image sticking or afterimage become larger in the vicinity of the intermediate color because the change of the transmittance becomes relatively large.

FIGS. 5A to 5D show another waveforms of the scan signals and the data signals in the active matrix addressed liquid crystal display device having the two-terminal switching element, and these drawings show the drive method of the pixel in order to reduce the image sticking or afterimage in a conventional art.

Figures 5A, 5B, 5C, 5D:
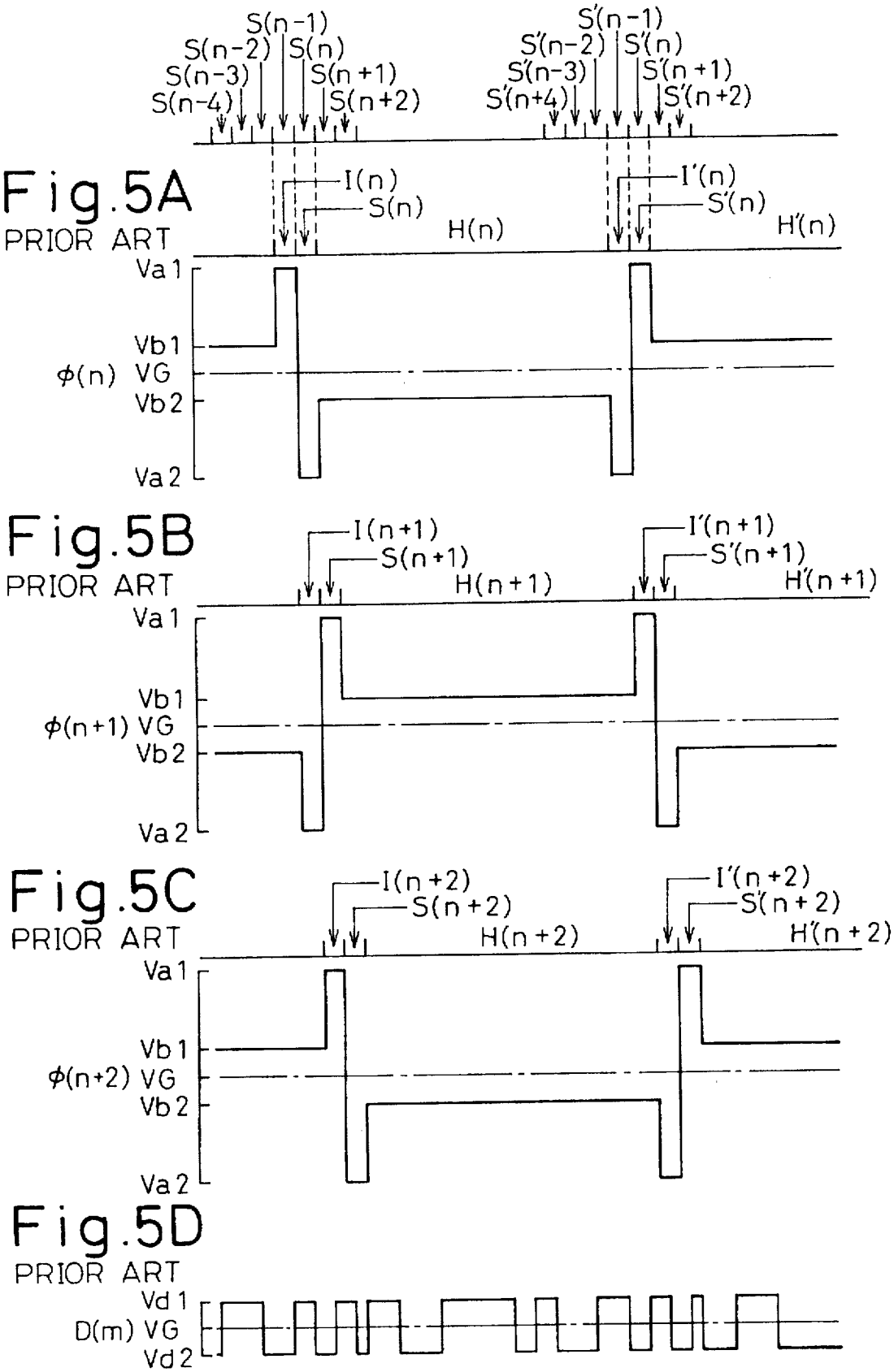
Fig.5A PRIOR ART
Fig.5B PRIOR ART
Fig.5C PRIOR ART
Fig.5D PRIOR ART
FIGS. 5A to 5D show waveforms of the scan signals and the data signals in the active matrix addressed liquid crystal display device having the two-terminal switching elements in the conventional art.

FIGS. 5A to 5C denote the scan signals $\phi(n)$, $\phi(n+1)$ and $\phi(n+2)$, and FIG. 5D denotes the data signal D(m). As explained in FIGS. 2A to 2C, the scan signal $\phi(n)$ is applied to the scan line "n", the scan signal $\phi(n+1)$ is applied to the scan line "n+1", and the scan signal $\phi(n+2)$ is applied to the scan line "n+2".

In selecting terms S(n), S'(n+1) and S(n+2), the scan signal indicates a negative polarity having the selecting potential Va2. In selecting terms S'(n), S(n+1) and S'(n+2), the scan signal indicates the positive polarity having the selecting potential Va1.

In holding terms H(n), H'(n+1) and H(n+2), the scan signal indicates the negative polarity having the holding potential Vb2. In holding terms H'(n), H(n+1) and H'(n+2), the scan signal indicates the positive polarity having the holding potential Vb1. The data signal D(m) is applied to the data line "m", and indicates alternately either the positive potential Vd1 or the negative potential Vd2.

Further, in order to reduce the image sticking or afterimage, a current applying term is provided just before the selecting term and just after the holding term. The current applying term has the polarity opposite to that of the selecting term.

In FIG. 5A, the current applying small term I(n) is provided just before the selecting term S(n), and the current applying small term I'(n) is provided just after the holding term H(n). In FIG. 5B, the current applying term I(n+1) is provided just before the selecting term S(n+1), and the current applying term I'(n+1) is provided just after the holding term H(n+1). In FIG. 5C, the current applying term I(n+2) is provided just before the selecting term S(n+2), and the current applying term I'(n+2) is provided just after the holding term H(n+2).

This conventional method aims to suppress the afterimage by changing and saturating the characteristic of the switching element in accordance with the current forcedly flowing therein in the current applying term.

However, in the above conventional method, it is very difficult to obtain a desired effect for reducing the image sticking or afterimage as explained below.

In FIG. 4B, the voltage waveform V and the current waveform I show waveforms when the scan signals shown in FIGS. 5A to 5C are applied to the switching element. For example, when the potential of the current applying term Γ(m) has the same polarity as the preceding selecting term S(m) (see, I(n)→S(n), Γ(n+1)→S(n+1), Γ(n+2)→S(n+2) in FIGS. 5A to 5C), the current does not flow in the switching element when it has an ideal non-linear current/voltage characteristic as shown by reference letters Ia and Ib (no peak portions on the graph) in FIG. 4A.

In this case, however, the small current can flow in the switching element as shown by reference letters Γa and Γb in FIG. 4B. This is because the switching element does not have the ideal non-linear current/voltage characteristic. However, these small currents Γa and Γb do not affect any effect on reducing the image sticking or afterimage.

On the other hand, if the potential of each current applying term Γ(n), Γ(n+1) and Γ(n+2) is set to a level larger than that of the selecting term S(n), S(n+1) and S(n+2), it is possible to change and saturate the characteristic of the switching element and to suppress the image sticking or afterimage.

However, in order to realize this method, it is necessary to provide a high voltage power source in addition to the current power source. As a result, the size of the circuit arrangement must be considerably increased and the voltage-proof value for the high voltage must also be increased. Accordingly, it is very difficult to employ the above method to reduce the afterimage.

Therefore, the object of the present invention is to provide an improved liquid crystal display device and a method of driving the same by increasing the amount of current flowing in the switching element without adding additional circuits or increasing the voltage-proof value of the element. As a result, the present invention can considerably reduce the image sticking or afterimage on the screen of the liquid crystal display device.

Figure 6A:
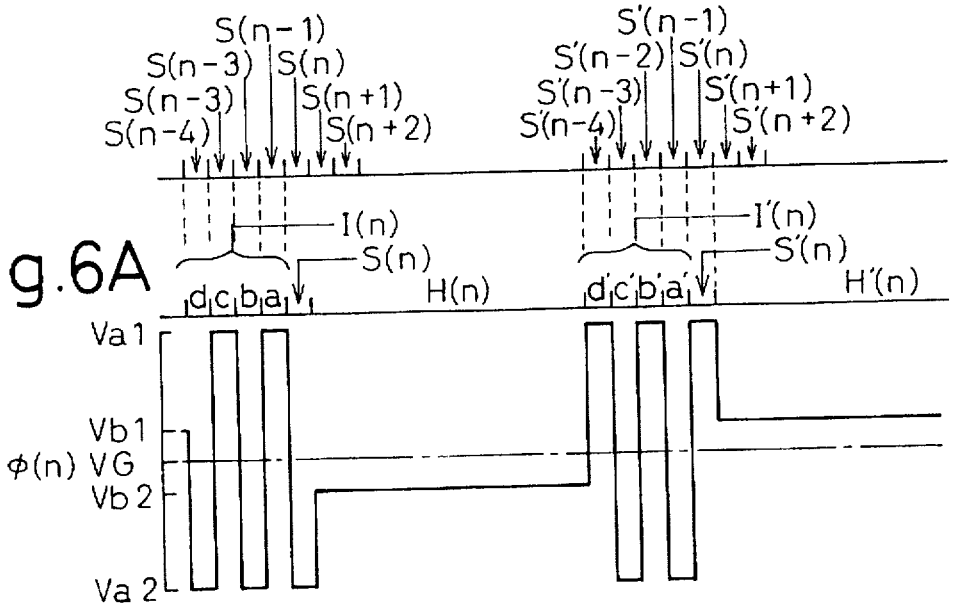
FIGS. 6A to 6D show waveforms of the scan signals and the data signals in the active matrix addressed liquid crystal display device having the two-terminal switching elements according to an embodiment of the present invention.
Figure 6B:
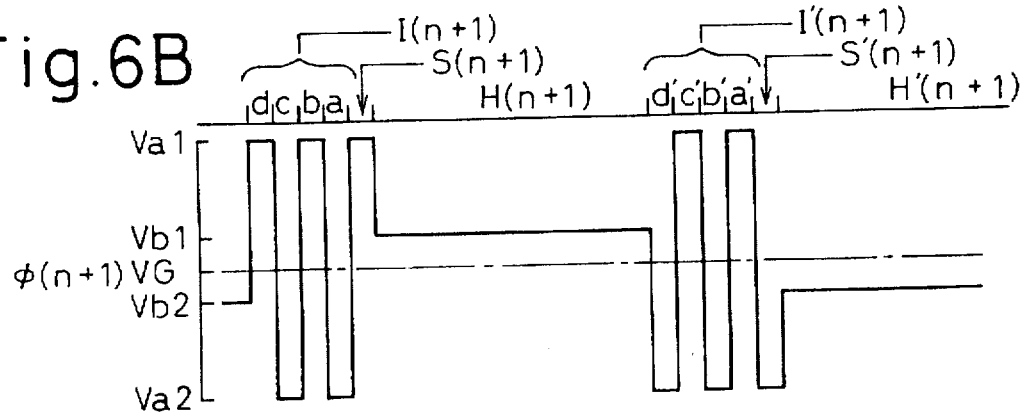
Figure 6C:
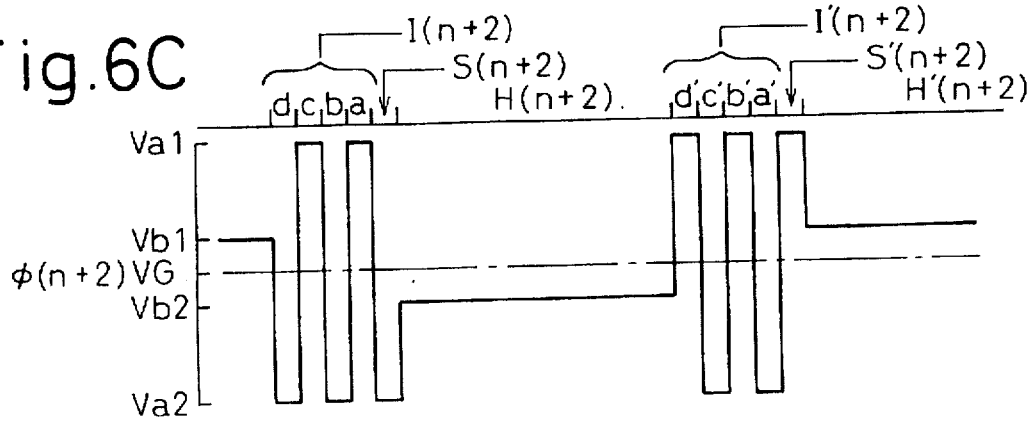
Figure 6D:
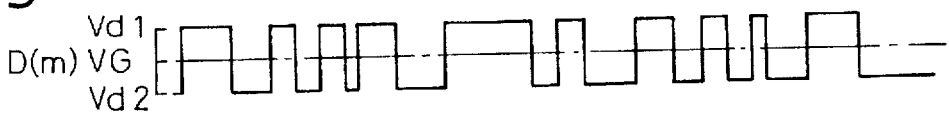

FIGS. 6A to 6D show waveforms of the scan signals and the data signals in the active matrix addressed liquid crystal display device having the two-terminal switching elements according to an embodiment of the present invention. As explained in preceding drawings, FIGS. 6A to 6C show the scan signals ϕ(n), ϕ(n+1) and ϕ(n+2) which are applied to the scan lines "n", "n+1" and "n+2", respectively. FIG. 6D shows the data signal D(m) which is applied to the data line "m".

Further, in FIGS. 6A to 6C, in selecting terms S(n), S'(n+1) and S(n+2), the scan signal indicates the negative polarity having the selecting potential Va2. In selecting terms S'(n), S(n+1) and S'(n+2), the scan signal indicates the positive polarity having the selecting potential Va1. Although the scan signal takes the selecting potential Va1 and Va2 for whole of the selecting terms in this embodiment, it is possible to take this potential to other potential for a certain part of the selecting term explained below.

On the other hand, in holding terms H(n), H'(n+1) and H(n+2), the scan signal indicates a negative polarity having the holding potential Vb2. In holding terms H'(n), H(n+1) and H'(n+2), the scan signal indicates a positive polarity having the holding potential Vb1. In FIG. 6D, the data signal D(m) indicates either the positive potential Vd1 or the negative potential Vd2. In these drawings, the reference potential VG is shown by the chain-dotted line.

Further, each polarity in selecting terms S(n), S(n+1) and S(n+2) is inverted for each adjacent scan line "n", "n+1" and "n+2", and the polarity in selecting terms S'(n), S'(n+1) and S'(n+2) is also inverted for each adjacent scan line "n", "n+1" and "n+2".

In this embodiment, for example, in FIG. 6A, more than three current applying small terms (see, "a" to "d" and "a'" to "d'" in the current applying terms I(n) and Γ(n)) are provided just before the selecting terms S(n) and S'(n). In this case, as explained below, the polarity of the potential of each small term is set to the same polarity as that of the selecting term, or set to the polarity opposite to that of the selecting term.

For example, in FIG. 6A, the current applying term I(n) includes four small terms "a" to "d" just before the selecting term S(n), and each small term has the same polarity or opposite polarity to the selecting term S(n). Similarly, the current applying terms Γ(n) includes four small terms "a'" to "d'" just before the selecting term S'(n), and each small term has the same polarity or opposite polarity to the selecting term S'(n). The same explanations as above are given to scan lines "n+1" and "n+2" in FIGS. 6B and 6C.

In the drawing, the small term "a" corresponds to the term S(n−1), the small term "b" corresponds to the term S(n−2), the small term "c" corresponds to the term S(n−3), and the small term "d" corresponds to the term S(n−4). Further, the small term "a'" corresponds to the term S'(n−1), the small term "b'" corresponds to the term S'(n−2), the small term "c'" corresponds to the term S'(n−3), and the small term "d'" corresponds to the term S'(n−4).

As is obvious, the term S(n−1), S(n−2), S(n−3) and S(n−4) correspond to selecting terms of another scan signal. Accordingly, these selecting terms can be utilized as the current applying term of the present invention.

In FIG. 6D, as shown in previous drawings, the data signal D(m) is applied to the data line "m", and indicates alternately either the positive potential Vd1 or the negative potential Vd2. Although, in general, either an amplitude modulation or a pulse width modulation is used for a display of the gray scale, the data signal D(m) is shown with pulse width modulation in this drawing.

Figure 7A:
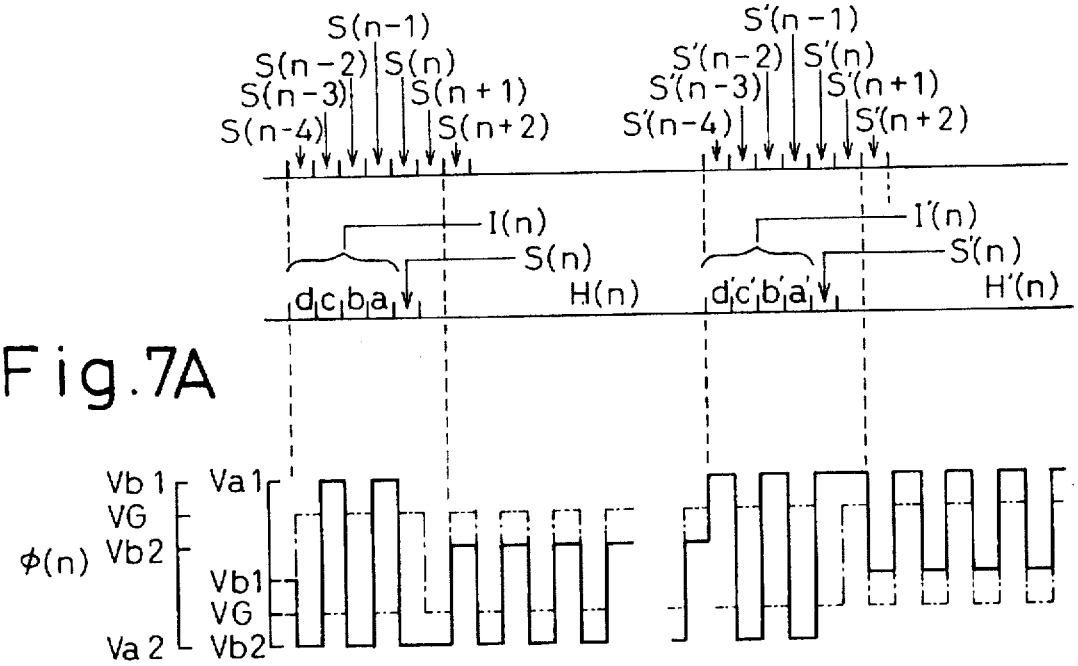
FIGS. 7A and 7B show waveforms of the scan signal and the data signal according to another embodiment of the present invention.
Figure 7B:
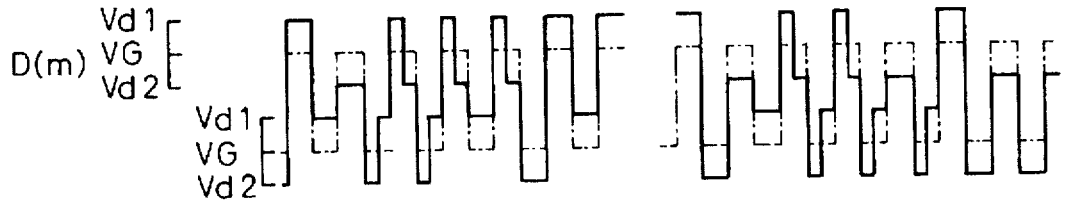

Although the reference potential VG is shown by the chain-dotted line as the constant potential, the reference potential VG can be changed for each term as shown in FIGS. 7A and 7B.

FIGS. 7A and 7B show waveforms of the scan signal and the data signal in the active matrix addressed liquid crystal display device having the two-terminal switching element according to another embodiment of the present invention. In this embodiment, the reference potential VG is changed for every selecting term as shown by chain-dotted lines. In FIG. 7A, the scan signal ϕ(n) corresponds to that of FIG. 6A. In FIG. 7B, the data signal D(m) corresponds to that of FIG. 6D.

This is because the reference potential VG is changed simultaneously for both the scan signal ϕ(n) and the data signal D(m), and the difference between both signals (ϕ(n) −D(m)), which the voltage is applied to the pixel and switching element, is identical with that of FIGS. 6A to 6D.

As a result of the change of the reference voltage, it is possible to reduce the amplitude of the scan signal potential even though it has to increase the amplitude of the data signal potential.

Figure 8A:
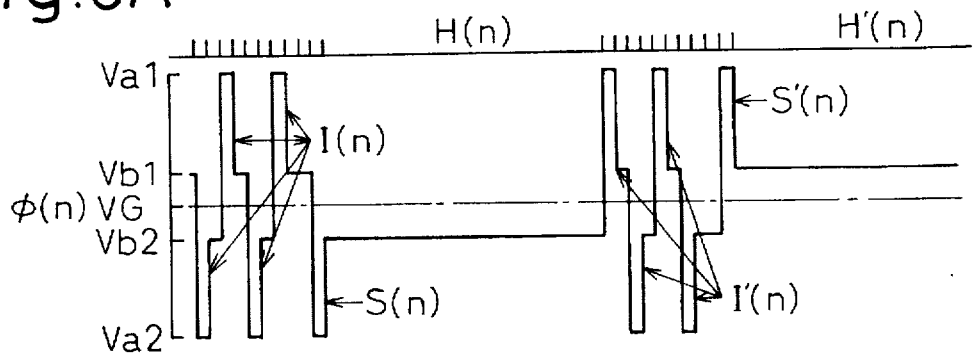
FIGS. 8A and 8C show waveforms of the scan signals and the data signal according to still another embodiment of the present invention.
Figure 8B:
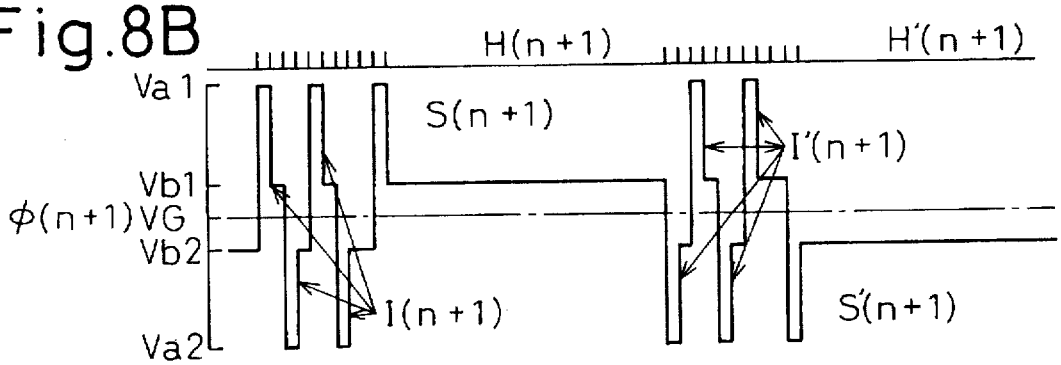
Figure 8C:
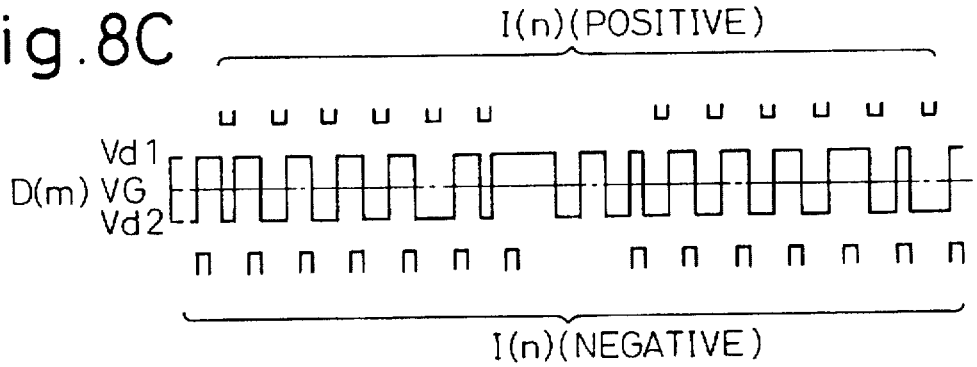

FIGS. 8A and 8B show waveforms of the scan signals and the data signal in the active matrix liquid crystal display device having the two-terminal switching element according to still another embodiment of the present invention. As shown in the preceding drawings, FIGS. 8A and 8B show the scan signals $\phi(n)$ and $\phi(n+1)$ which are applied to the scan lines "n" and "n+1", respectively. FIG. 8C shows the data signal D(m) which is applied to the data line "m".

In FIGS. 8A and 8B, in selecting terms S(n) and S'(n+1), the scan signal indicates the negative polarity having the selecting potential Va2. In selecting terms S'(n) and S(n+1), the scan signal indicates the positive polarity having the selecting potential Va1. Further, in holding terms H(n) and H'(n+1), the scan signal indicates the negative polarity having the holding potential Vb2. In holding terms H'(n) and H(n+1), the scan signal indicates the positive polarity having the holding potential Vb1. In FIG. 8C, the data signal D(m) is applied to the data line "m", and indicates alternately either the positive potential Vd1 or the negative potential Vd2. In these drawings, the reference potential VG is set to the constant potential as shown by the chain-dotted line.

The potential in the selecting term S(n) is always set to the potential Va2, and the potential in the selecting term S'(n) is always set to the potential Va1 in this embodiment. However, in the part of these selecting terms, it is possible to set this potential to another potential, for example, Vb1 or Vb2.

In this embodiment, the current applying term I(n) includes a plurality of discontinuous small terms. In each small term, the polarity of the potential of the data signal is opposite to that of the scan signal. For example, in FIG. 8A, the current applying term I(n) is provided before the selecting term S(n), and divided into four small terms. Further, in each small term, the scan signal alternately takes one of two potentials Va1 or Va2.

On the other hand, in FIG. 8C, the upper side shows the positive polarity of the current applying terms I(n) and I(n+1), and the lower side shows the negative polarity of the current applying terms I(n) and I(n+1). As is obvious, each current applying term is set to the polarity opposite to the potential Vd1, Vd2 of the data signal. For example, when the current applying term I(n) and I(n+1) takes the positive potential Va1, the data signal D(m) takes the negative potential Vd2. On the contrary, when the current applying term I(n) and I(n+1) takes the negative potential Va2, the data signal D(m) takes the positive potential Vd1.

Figure 9:
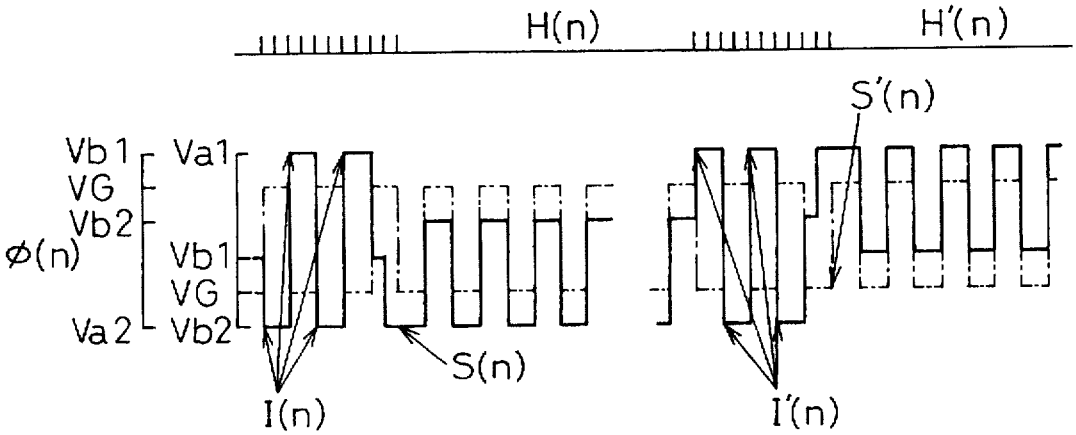
FIG. 9 shows a waveform of the scan signals and the data signal according to still another embodiment of the present invention.

FIG. 9 shows a waveform of the scan signals and the data signal according to still another embodiment of the present invention. This drawing is identical with FIGS. 8A and 8B. In FIG. 9, the reference potential VG of FIGS. 8A and 8B is changed for every term so that the amplitude of the scan signal can be decreased. On the contrary, the amplitude of the data signal is increased. Although the drive waveform appears to be different from FIGS. 8A and 8B, the waveform is identical relative to ground with FIGS. 8A and 8B.

Figure 10:
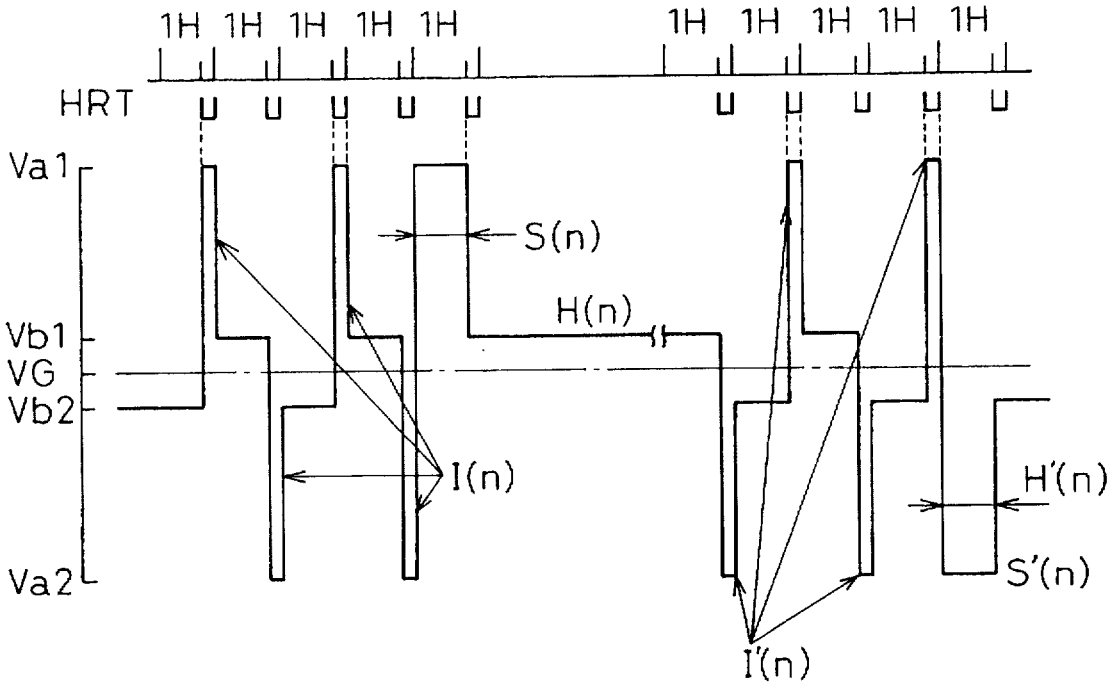
FIGS. 10 shows waveforms of the scan signal according to still another embodiment of the present invention.

FIG. 10 shows waveforms of the scan signal and the data signal in the active matrix addressed liquid crystal display device having the two-terminal switching element according to still another embodiment of the present invention. This embodiment is preferably adapted to a television system. In this embodiment, horizontal retracing terms, which are parts of horizontal scan period (1H) in the television system are utilized as the current applying small term I(n) of the present invention. This is because an image information of a video signal is not transferred in the horizontal retracing term H in the television so that it is possible to utilize this horizontal retracing term as the current applying term and to pass the current to the switching element without any influence on the signal processing. As shown in the drawing, each current applying small term I(n) is set to less than one-third of the selecting term S(n) so that it is possible to decrease the deterioration in the drivability of the device.

Further, since the current applying term is formed of a plurality of discontinuous current applying small terms, and the scan signals have the same holding potential as that of the holding term in each of the discontinuous current applying small terms, it is possible to eliminate influence of the data signals between current applying small terms and to reduce fluctuation of the threshold voltage which is dependent on the contents of the data signal. Further, it is possible to maintain the minimum load for the circuit and the power source.

Figure 11:
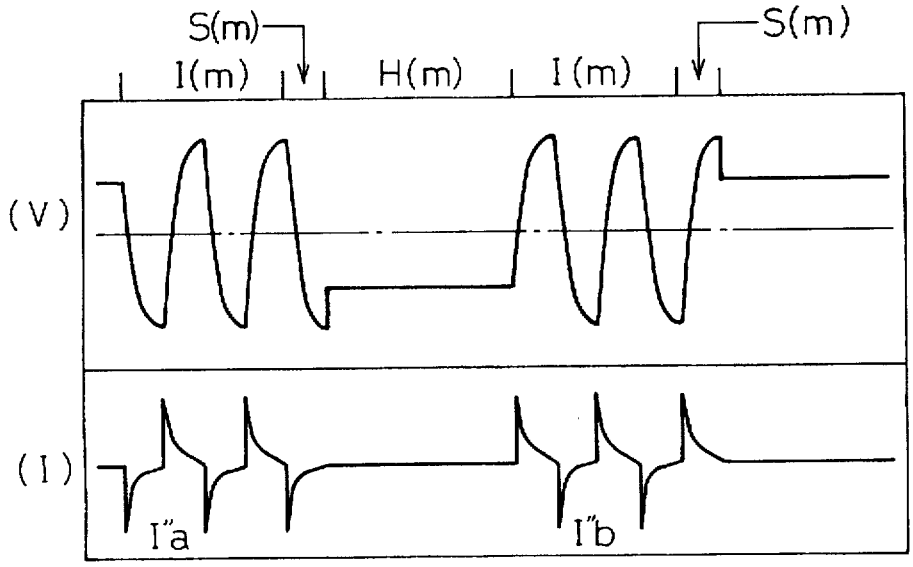
FIG. 11 is a waveform of the voltage and current in the switching elements and the liquid crystal elements when the scan signal of FIGS. 6A to 6C are applied thereto.

FIG. 11 is a waveform of the voltage and current in the switching element and the pixel according to the present invention when the scan signal shown in FIGS. 6A to 6C are applied to the switching element. In FIG. 11, as shown by the waveform V, very large voltage are alternately provided in the current applying terms I(m). Further, the charge current I flows to the pixel in the form of the differential pulse in accordance with the non-linear current/voltage characteristic of the switching element in these terms.

As is obvious by comparing FIG. 4B with FIG. 11, a very large current having the alternate polarity (I"a) and (I"b) flows in the switching element so that it is possible to reduce the image sticking or afterimage.

Figure 12A:
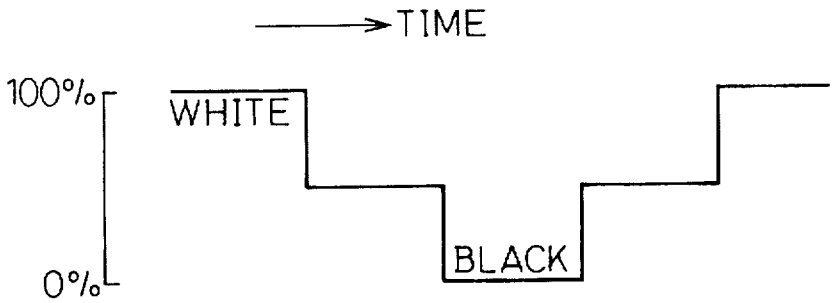
FIGS. 12A and 12B are explanatory views for explaining a transmission factor of the light in cases of the ideal characteristic (A) and the actual characteristic (B) in the present invention.
Figure 12B:
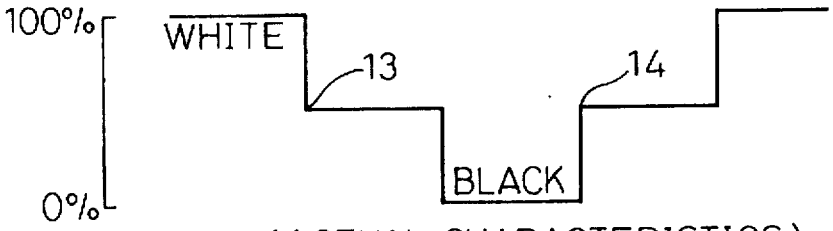

FIGS. 12A and 12B are explanatory views for explaining the transmittance of the light in cases of the ideal characteristic (A) and the actual characteristic (B) in the present invention. Although FIG. 12A is the same as FIG. 3A, this drawing is added to compare the effect of the present invention with the ideal characteristic.

In FIGS. 12A and 12B, as shown in the preceding drawings, the ordinate denotes the transmittance of the light, and the abscissa denotes the time. When the gray scale of the color is sequentially changed from white→intermediate color→black→intermediate color→to white, in the present invention, no image sticking or afterimage is found on the screen as shown by FIG. 12B.

That is, in the timing when the gray scale of the color is changed from white to the intermediate color, and from black to the intermediate color, there is no large dip and large peak as shown by the reference numbers 13 and 14 in FIG. 12B since the large amount of the current continuously flows in the switching element as shown in FIG. 11.

Figure 13:
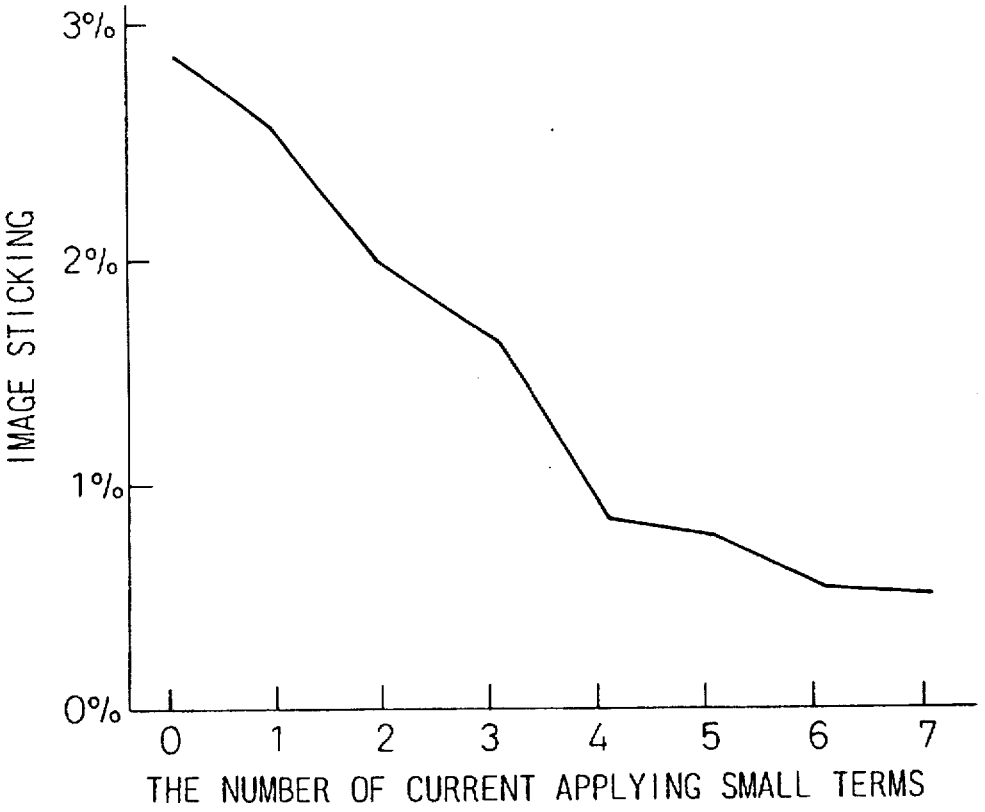
FIG. 13 is a graph for explaining one example of the effect according to the present invention.

FIG. 13 is a graph for explaining the effect of this embodiment of the present invention. The ordinate denotes a rate (%) of the image sticking afterimage, and the abscissa denotes the number of the current applying small terms. As is obvious from the graph, when the number of the current applying small terms exceeds four, the rate of the image sticking or afterimage fall to under 1 (%) so that it is possible to achieve the considerable effect of the present invention.

Figure 14:
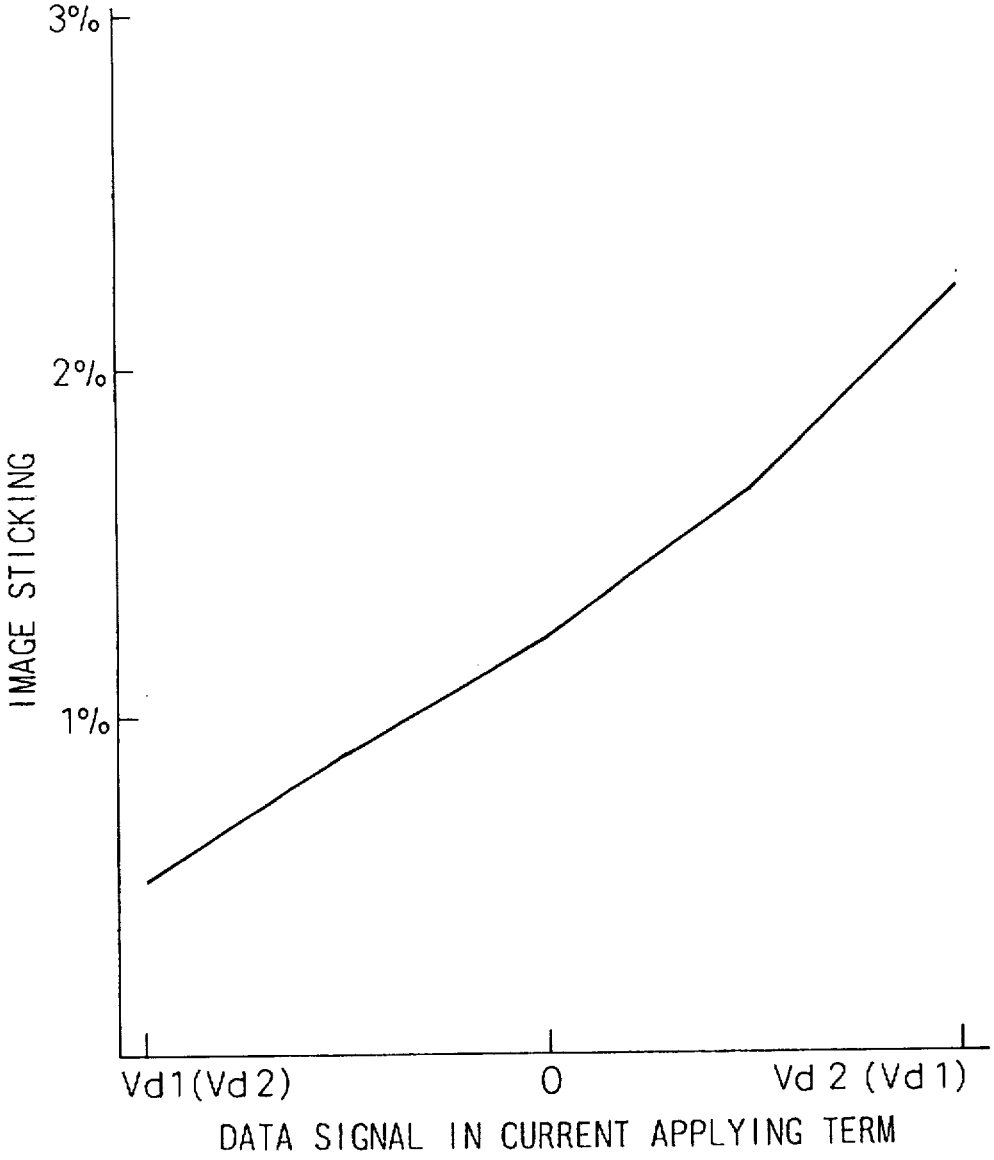
FIG. 14 is a graph for explaining the relationship between the image sticking or afterimage and the potential of the data signal.

FIG. 14 is a graph for explaining the relationship between the image sticking or afterimage and the potential of the data signal. The ordinate denotes a rate (%) of the image sticking or afterimage, and the abscissa denotes the potential of the data signal in the current applying small terms. When the negative potential Va2 of the scan signal is applied to the scan line in the current applying small terms, the graph shows the relationship between the image sticking or afterimage and the potential of the data signal. That is, when the data signal D(m) takes the negative potential Vd2 (right side of the graph), the image sticking or afterimage becomes large. When it takes the positive potential Vd1 (left side of the graph), the image sticking or afterimage becomes small.

Figure 15:
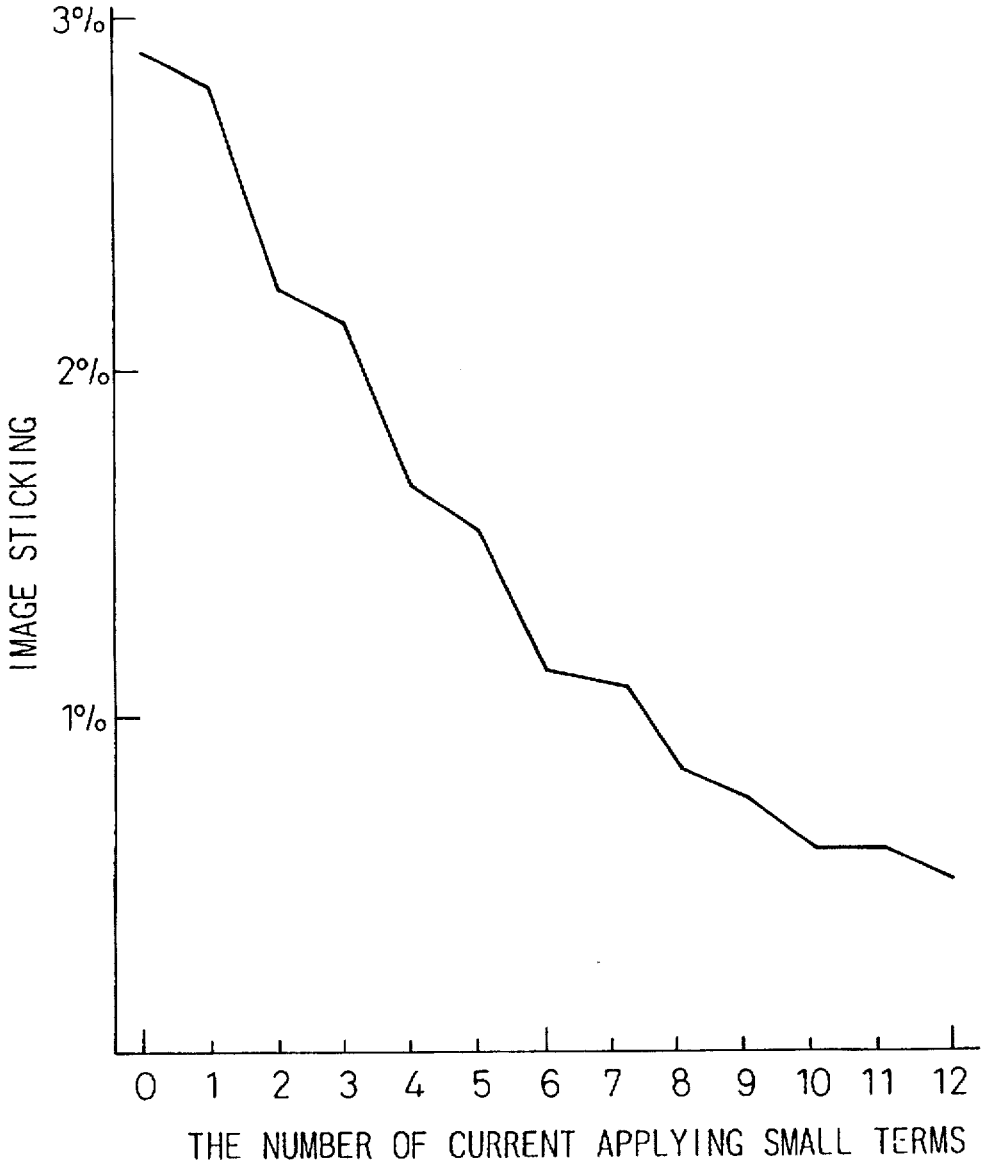
FIG. 15 is a graph for explaining another example of the effect according to the present invention.

FIG. 15 is a graph for explaining another example of the effect in the embodiment using the waveforms shown in FIGS. 8A to 8C. The ordinate denotes the level of the image sticking or afterimage, and abscissa denotes the numbers of the current applying small terms (small term). In this case, the current applying term I(n) is set to one-third of the selecting term S(n). As is obvious from the graph, the greater the number of the current applying small terms, the lower the level of the image sticking or afterimage.

I claim:

1. A liquid crystal display device comprising:

a plurality of data lines;

a plurality of scan lines, each intersected with each of said plurality of data lines;

liquid crystal elements, each provided to a respective one of the intersecting points of said plurality of data lines and scan lines;

two-terminal switching elements, each provided to a respective one of the intersecting points of said plurality of data lines and scan lines;

a data line drive means for generating data signals to drive said data lines; and a scan line drive means for generating scan signals to drive said scan lines; each said scan signals being formed of a selecting term, a holding term following the selecting term, and a current applying term preceding the selecting term and following the holding term for applying a current to the two-terminal switching element by applying a voltage exceeding a threshold voltage of the two-terminal switching element thereto; said current applying term being formed by more than three current applying small terms; and said more than three small terms being formed by the same polarity of potential as that of said selecting term, and by the polarity of potential opposite to that of the selecting term.

2. A liquid crystal display device as claimed in claim 1, wherein said current applying term is formed by more than four current applying small terms; and said more than four small terms include more than two of said small terms having the same polarity of potential as that of said selecting terms, and more than two of said small terms having the polarity of potential opposite to said selecting terms.

3. A liquid crystal display device as claimed in claim 1, wherein said current applying term utilizes selecting terms of other scan lines, and the polarity of the potential of said scan signals at said current applying term having the same polarity of potential as that of selecting term at another scan lines.

4. A liquid crystal display device as claimed in claim 1, wherein the potential at said small terms at the current applying term is approximately equal to that of a positive potential or a negative potential of selecting term.

5. A liquid crystal display device comprising:

a plurality of data lines;

a plurality of scan lines, each intersected with each of said plurality of data lines;

liquid crystal elements, each provided to a respective one of the intersecting points of said plurality of data lines and scan lines;

two-terminal switching elements, each provided to a respective one of the intersecting points of said plurality of data lines and scan lines;

a data line drive means for generating data signals to drive said data lines; and a scan line drive means for generating scan signals to drive said scan lines; each of said scan signals being formed of a selecting term, a holding term following the selecting term, and a current applying term preceding the selecting term and following the holding term for applying a current to the two-terminal switching element by applying a voltage exceeding a threshold voltage of the two-terminal switching element thereto; said current applying term being formed by a plurality of discontinuous current applying small terms; and the polarity of potential of said data signals at said current applying small terms being opposite to that of said scan signals at said current applying small terms.

6. A liquid crystal display device as claimed in claim 5, wherein each of said data signal becomes an upper data potential Vd1, a lower data potential Vd2 and an intermediate data potential therebetween in the selecting term, and becomes either the upper data potential Vd1 or the lower data potential Vd2 in the current applying small terms of said scan signals.

7. A liquid crystal display device as claimed in claim 5, wherein said plurality of current applying small terms being formed by small terms having the same polarity of potential as that of selecting terms, and by the small terms having the polarity opposite to that of selecting terms.

8. A liquid crystal display device as claimed in claim 5, wherein said current applying term is formed by more than four current applying small terms; and said more than four small terms include more than two of said small terms having the same polarity of potential as that of said selecting terms, and more than two of said small terms having the polarity of potential opposite to said selecting terms.

9. A liquid crystal display device as claimed in claim 5, wherein each of said scan signals becomes an upper selecting potential Va1 and a lower selecting potential Va2 in the selecting terms, becomes an upper holding potential Vb1 and a lower holding potential Vb2 in the holding terms, and becomes the upper selecting potential Va1 and the lower selecting potential Va2 in the current applying small terms preceding to the selecting terms.

10. A liquid crystal display device as claimed in claim 5, wherein said current applying small terms utilize a horizontal retracing term of a video signal.

11. A liquid crystal display device as claimed in claim 5, wherein each of said small terms is set to less than one-third of said selecting term.

12. A method for driving a liquid crystal display device including: a plurality of data lines; a plurality of scan lines, each intersected with each of said plurality of data lines; liquid crystal elements, each provided to a respective one of the intersecting points of said plurality of data lines and scan lines; two-terminal switching elements, each provided to a respective one of the intersecting points of said plurality of data lines and scan lines; a data line drive means for generating data signals to drive said data lines; and a scan line drive means for generating scan signals to drive said scan lines; said method comprising the steps of:

setting each of said scan signals so as to be formed of a selecting term, a holding term following to the selecting term, and a current applying term preceding the selecting term and following the holding term for applying a current to the two-terminal switching element by applying a voltage exceeding a threshold voltage of the two-terminal switching element thereto;

setting said current applying term so as to be formed by more than three current applying small terms; and setting said more than three small terms so as to be formed by the same polarity of potential as that of said selecting term, and by the polarity of potential opposite to that of the selecting term.

13. A method for driving a liquid crystal display device as claimed in claim 12, wherein said setting of said current applying term is performed so as to be formed by more than four current applying small terms; and said more than four small terms include more than two of said small terms having the same polarity of potential as that of said selecting terms, and more than two of said small terms having the polarity of potential opposite to said selecting terms.

14. A method for driving a liquid crystal display device as claimed in claim 12, wherein said setting of said current applying term is performed by utilizing selecting terms of other scan lines, and the polarity of potential of said scan signals at said current applying term having the same polarity of potential as that of selecting term at other scan lines.

15. A method for driving a liquid crystal display device as claimed in claim 12, wherein setting of the potential at said small terms at the current applying term is performed so as to be approximately equal to that of a positive potential or a negative potential of selecting term.

16. A method for driving a liquid crystal display device including: a plurality of data lines; a plurality of scan lines, each intersected with each of said plurality of data lines; liquid crystal elements, each provided to a respective one of the intersecting points of said plurality of data lines and scan lines; two-terminal switching elements, each provided to a respective one of the intersecting points of said plurality of data lines and scan lines; a data line drive means for generating data signals to drive said data lines; and a scan line drive means for generating scan signals to drive said scan lines; said method comprising the steps of:

setting each of said scan signals so as to be formed of a selecting term, a holding term following the selecting term, and a current applying term preceding the selecting term and following the holding term for applying a current to the two-terminal switching element by applying a voltage exceeding a threshold voltage of the two-terminal switching element thereto;

setting said current applying term so as to be formed by a plurality of discontinuous current applying small terms; and setting the polarity of potential of said data signals at said current applying small terms so as to be opposite to that of said scan signals at said current applying small terms.

17. A method for driving a liquid crystal display device as claimed in claim 16, wherein setting of each of said data signal is performed so as to become an upper data potential Vd1, a lower data potential Vd2 and an intermediate data potential therebetween in the selecting term, and to become either the upper data potential Vd1 or the lower data potential Vd2 in the current applying small terms of said scan signals.

18. A method for driving a liquid crystal display device as claimed in claim 16, wherein setting of said plurality of current applying small terms is performed so as to be formed by small terms having the same polarity of potential as that of selecting terms, and by the small terms having the polarity opposite to that of selecting terms.

19. A method for driving a liquid crystal display device as claimed in claim 16, wherein setting of said current applying term is performed so as to formed by more than four current applying small terms; and said more than four small terms include more than two of said small terms having the same polarity of potential as that of said selecting terms, and more than two of said small terms having the polarity of potential opposite to said selecting terms.

20. A method for driving a liquid crystal display device as claimed in claim 16, wherein setting of each of said scan signals is performed so as to become an upper selecting potential Va1 and a lower selecting potential Va2 in the selecting terms, to become an upper holding potential Vb1 and a lower holding potential Vb2 in the holding terms, and to become the upper selecting potential Va1 and the lower selecting potential Va2 in the current applying small terms preceding the selecting terms.

21. A method for driving a liquid crystal display device as claimed in claim 16, wherein setting of said current applying small terms is performed by utilizing a horizontal retracing term of a video signal.

22. A method for driving a liquid crystal display device as claimed in claim 16, wherein setting of each of said small terms is performed by setting it to less than one-third of said selecting term.

23. A liquid crystal display device comprising:

a plurality of data lines;

a plurality of scan lines, each intersected with each of said plurality of data lines;

liquid crystal elements, each provided to a respective one of the intersecting points of said plurality of data lines and scan lines;

two-terminal switching elements, each provided to a respective one of the intersecting points of said plurality of data lines and scan lines;

a data line drive means for generating data signals to drive said data lines; and a scan line drive means for generating scan signals to drive said scan lines; each of said scan signals being formed of a selecting term, a holding term following the selecting term, and a current applying term preceding the selecting term and following the holding term for applying a current to the two-terminal switching element by applying a voltage exceeding a threshold voltage of the two-terminal switching element thereto; said current applying term being formed of a plurality of discontinuous current applying small terms; and said scan signals having the same holding potential as that of the holding term in each of said discontinuous current applying small terms.

24. A method for driving a liquid crystal display device including: a plurality of data lines; a plurality of scan lines, each intersected with each of said plurality of data lines; liquid crystal elements, each provided to a respective one of the intersecting points of said plurality of data lines and scan lines; two-terminal switching elements, each provided to a respective one of the intersecting points of said plurality of data lines and scan lines; a data line drive means for generating data signals to drive said data lines; and a scan line drive means for generating scan signals to drive said scan lines; said method comprising the steps of:

setting each of said scan signals so as to be formed of a selecting term, a holding term following the selecting term, and a current applying term preceding the selecting term and following the holding term for applying a current to the two-terminal switching element by applying a voltage exceeding a threshold voltage of the two-terminal switching element thereto;

setting said current applying term so as to be formed of a plurality of discontinuous current applying small terms; and setting said scan signals so as to have the same holding potential as that of the holding term in each of said discontinuous current applying small terms.

* * * * *